US008083192B2

(12) United States Patent
Wells et al.

(10) Patent No.: US 8,083,192 B2
(45) Date of Patent: Dec. 27, 2011

(54) POLE MOUNTING SYSTEM AND METHOD

(75) Inventors: Robbie D. Wells, Chippendale (AU); Jonathan L. Liston, Chippendale (AU)

(73) Assignee: Hub Street Equipment Pty Ltd, Chippendale (AU)

( * ) Notice: Subject to any disclaimer, the term of this patent is extended or adjusted under 35 U.S.C. 154(b) by 0 days.

(21) Appl. No.: 11/553,177

(22) Filed: Oct. 26, 2006

(65) Prior Publication Data

US 2007/0257164 A1 Nov. 8, 2007

(30) Foreign Application Priority Data

Oct. 27, 2005 (AU) ..... 2005905956

(51) Int. Cl.

| | |
|---|---|
| ***A47B 96/06*** | (2006.01) |
| ***E04G 3/00*** | (2006.01) |
| ***E04G 5/00*** | (2006.01) |
| ***F21V 35/00*** | (2006.01) |

(52) U.S. Cl. ..... 248/218.4; 248/219.3; 248/230.1; 248/230.5; 248/231.5

(58) Field of Classification Search ..... 248/218.4, 248/219.4, 219.3

See application file for complete search history.

(56) References Cited

U.S. PATENT DOCUMENTS

| | | | | |
|---|---|---|---|---|
| 3,374,978 | A * | 3/1968 | Salmon et al. | 211/107 |
| 3,734,438 | A * | 5/1973 | Kautz | 211/107 |
| 3,750,992 | A * | 8/1973 | Johnson | 211/107 |
| 4,117,629 | A * | 10/1978 | Ekdahl | 47/67 |
| 4,781,348 | A * | 11/1988 | Cutforth et al. | 248/218.4 |
| 5,228,657 | A * | 7/1993 | Hall | 248/230.9 |
| 5,275,368 | A * | 1/1994 | Hall et al. | 248/218.4 |
| 5,542,776 | A * | 8/1996 | Reynolds | 403/389 |
| 6,575,652 | B2 * | 6/2003 | Krauss | 403/49 |
| 2003/0213152 | A1 | 11/2003 | Kim | |

FOREIGN PATENT DOCUMENTS

| | | |
|---|---|---|
| AU | 741307 | 12/1998 |
| GB | 2 272 716 | 5/1994 |

* cited by examiner

*Primary Examiner* — Amy J Sterling

(74) *Attorney, Agent, or Firm* — Connolly Bove Lodge & Hutz LLP

(57) ABSTRACT

A pole mounting system for attaching auxiliary equipment to street poles is provided. The system comprises a pair of substantially part cylindrical clamps and tightening means to advance the clamps towards each other and thereby grasp an elongate pole about a substantially transverse cross-section thereof. Each of the clamps includes a multiplicity of spaced apart locator sites extending therearound and wherein each of the auxiliary equipment includes a substantially L-shaped portion having a foot which engages with at least some of the locator sites and a stem which depends from the foot whereby the attachment can be temporarily supported by inter-engagement of the foot and clamp(s). The radial positioning of the auxiliary equipment verified before the auxiliary equipment is secured to the clamp(s).

9 Claims, 6 Drawing Sheets

POLE MOUNTING SYSTEM AND METHOD

FIELD OF THE INVENTION

The present invention relates to street poles and, in particular, to a mounting system and method enabling ancillary equipment to be positioned on street poles.

BACKGROUND OF THE INVENTION

Street poles are widely used to mount a wide range of ancillary equipment such as street name signs, banners, traffic lights, traffic signs, aerials, street lights, and the like.

Many methods of mounting such ancillary equipment to poles are known. The most traditional method is to drill the pole, and insert fasteners through a mounting bracket, or similar and into the pole itself. However, such traditional methods are increasingly frowned upon for three reasons. Firstly, they are time intensive and occupational health and safety standards indicate that the amount of time spent working at an elevated position especially if standing on a ladder, should be kept to an absolute minimum. Secondly, it is necessary to radially position the ancillary equipment with precision. For example, at a V-shaped intersection it is important that street name signs be correctly aligned with the corresponding streets since a misalignment by only a small number of degrees may possibly create confusion in the minds of those unfamiliar with the local territory and seeking to utilise the information contained on the street name sign. Thirdly, drilling a hole in a pole generally exposes the pole to corrosion and rust which can effectively shorten pole life.

Another traditional method of mounting such ancillary equipment is to use a strip of flexible metal, similar in construction to an automotive radiator hose clamp, but suitably enlarged to accommodate the diameter of the pole. However, such fastening arrangements suffer from the difficulty that the ancillary equipment must be held in place by one hand and whilst the clamp is tightened by the other. This is dangerous while working up a ladder since no hand is available to steady the workman and thus a fall is possible, if not probable. Furthermore, once tightened the radial orientation of the ancillary equipment cannot be changed without slacking off the entire arrangement whilst supporting the ancillary equipment, and repeating the entire procedure.

A pole which has in recent years been installed in the downtown area of the City of Sydney, Australia, is described in Australian Patent No. 741,307. This pole is relatively expensive because it provides an elaborate means of attachment which is present whether required or not. The means of attachment is fabricated from shaped metal so as to provide attachments orientated in four predetermined directions, say north, south, east and west. However, this requires the pole itself to be correctly orientated and the radial orientation of the ancillary equipment to be determined in advance. If either the pole is incorrectly orientated, or a new item of ancillary equipment is required to be mounted on the pole in a direction which does not correspond to one of the four predetermined directions, then a very complicated additional bracket is required in order to mount, say, an antenna, having an orientation, say, to the south-east.

OBJECT OF THE INVENTION

The present invention is directed towards substantially overcoming, or at least ameliorating, the abovementioned difficulties, or providing a useful alternative.

SUMMARY OF THE INVENTION

In accordance with a first aspect of the present invention there is disclosed a pole mounting system for attaching auxiliary equipment to street poles, said system comprising a pair of substantially part cylindrical clamps and tightening means to advance said clamps towards each other and thereby grasp an elongate pole about a substantially transverse cross-section thereof wherein each of said clamps includes a plurality at spaced apart locator sites extending therearound and wherein each of said auxiliary equipment includes an upper engagement portion having at least one aperture for receiving a locking pin therethrough for engagement with one of said locator sites on one of said clamps whereby said attachment can be temporarily supported by inter-engagement of said locking pin through said upper engagement portion aperture and clamp(s), and the radial positioning of said auxiliary equipment verified before said auxiliary equipment is secured to said clamps.

In accordance with a second aspect of the present invention there is disclosed a method of attaching auxiliary equipment, said method comprising the steps of:

(i) clamping a split collar to said pole;

(ii) temporarily inter-engaging a portion of said auxiliary equipment with said collar;

(iii) checking the radial positioning of said auxiliary equipment relative to said pole;

(iv) repositioning said auxiliary equipment and repeating steps (ii) and (iii);

(v) securing said auxiliary equipment to said collar.

In accordance with a third aspect of the invention there is provided a pole having at least one mounting system according to the first aspect of the invention.

BRIEF DESCRIPTION OF THE DRAWINGS

A preferred embodiment of the invention will now be described, by way of example only, with reference to the accompanying drawings in which.

DETAILED DESCRIPTION OF THE PREFERRED EMBODIMENT

Figure 1:
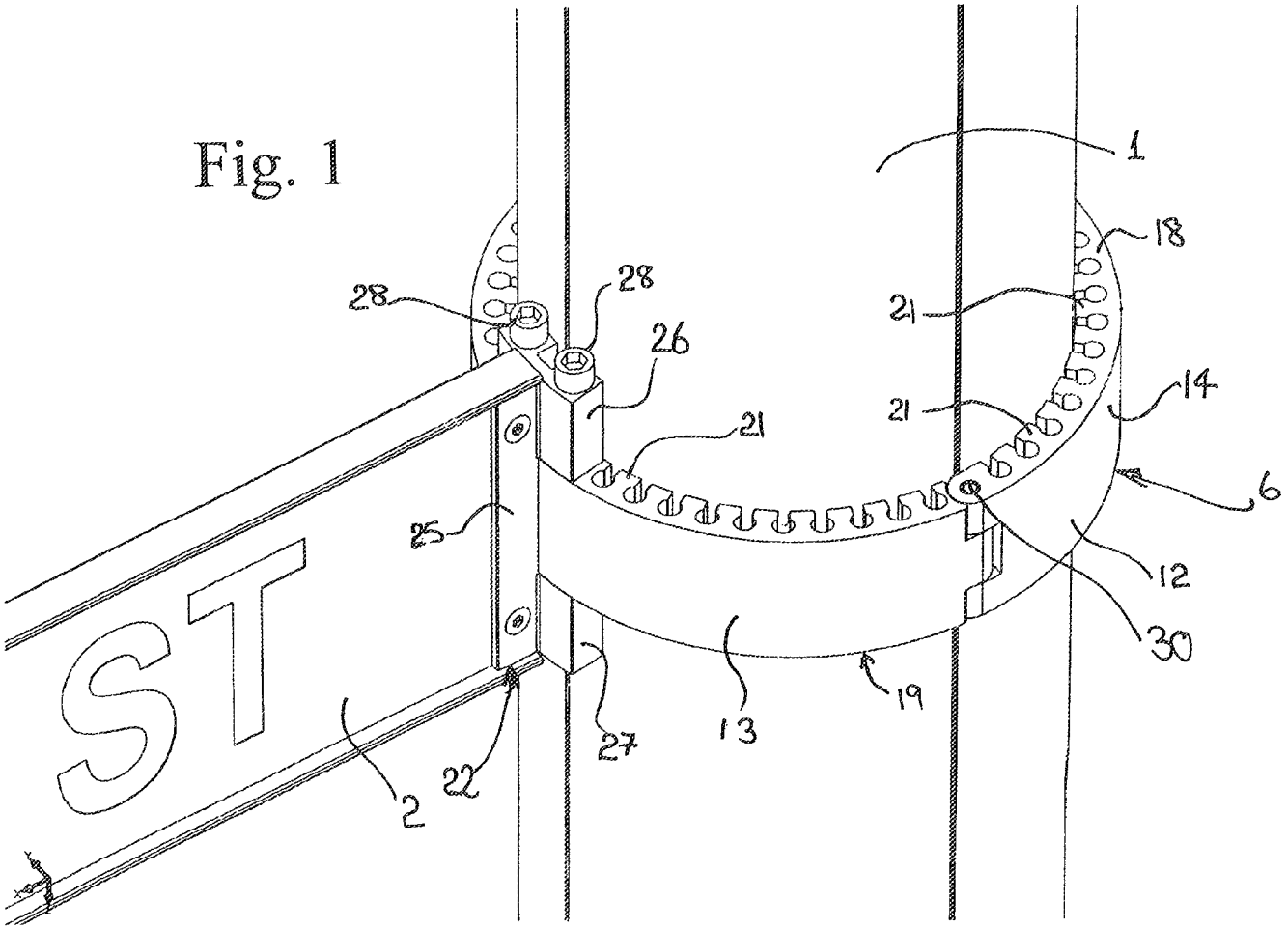
FIG. 1 is an enlarged view of a pole mounting system in accordance with the preferred embodiment.
Figure 2:
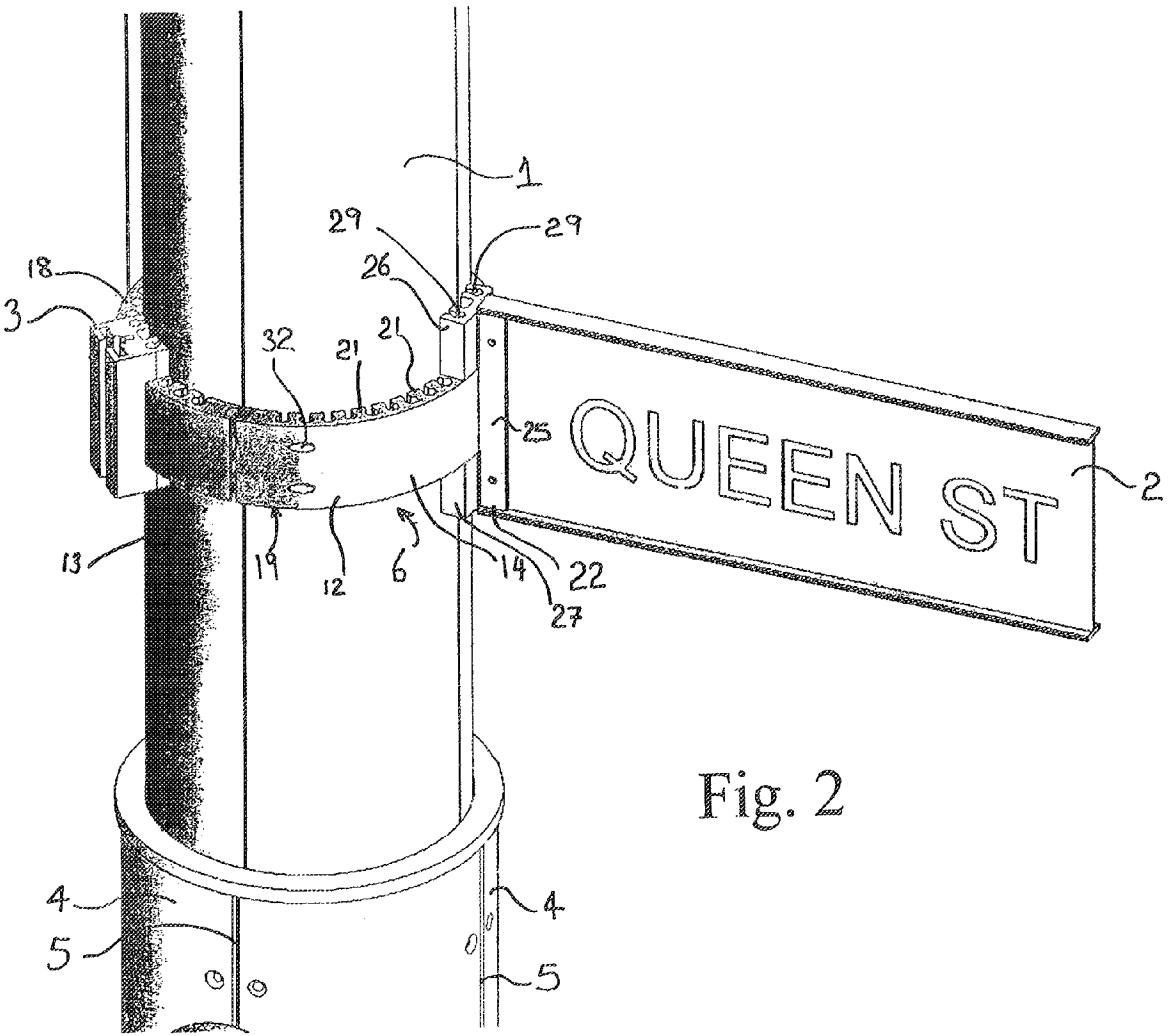
FIG. 2 is a perspective view of the system of FIG. 1 with auxiliary equipment temporarily attached.
Figure 3:
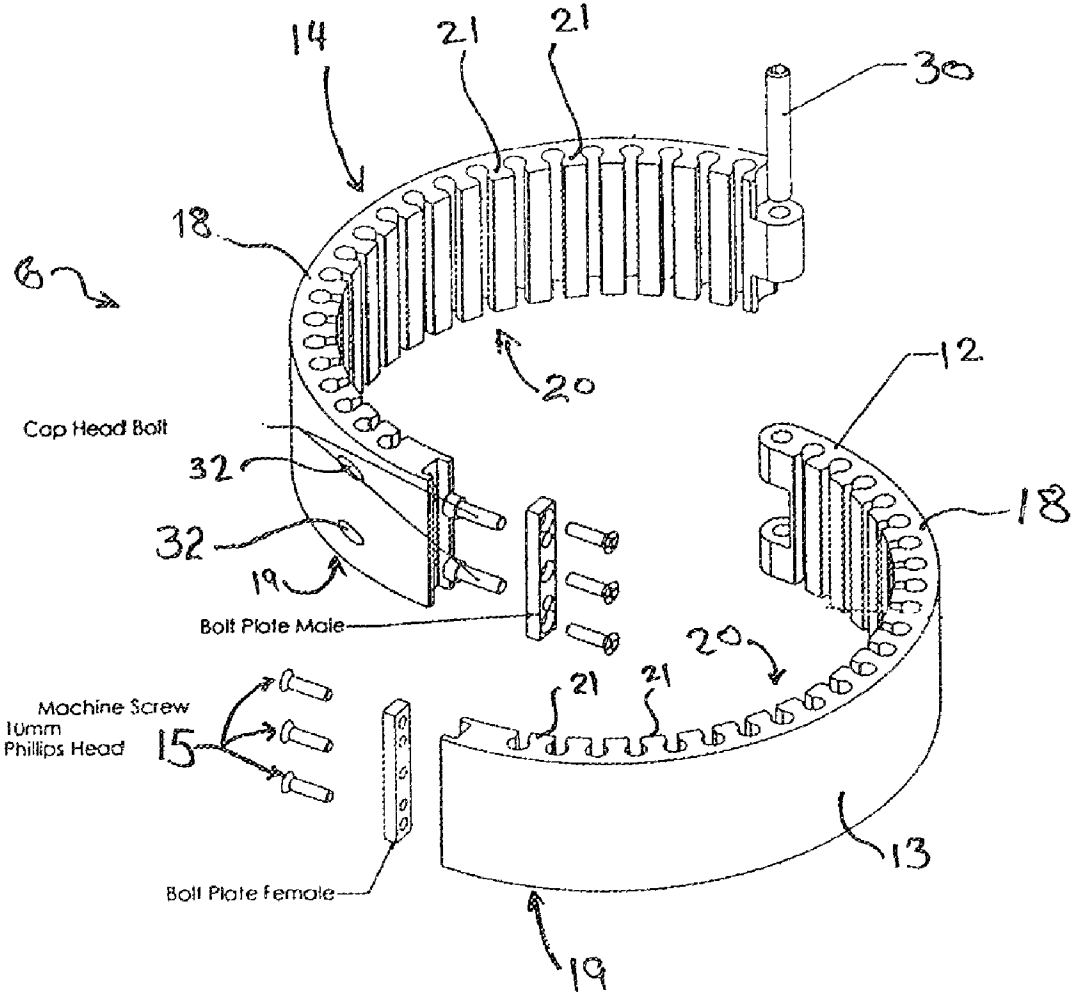
FIG. 3 is an exploded perspective view of a pair of part cylindrical clamps of FIGS. 1 and 2 used to mount auxiliary equipment.
Figure 4:
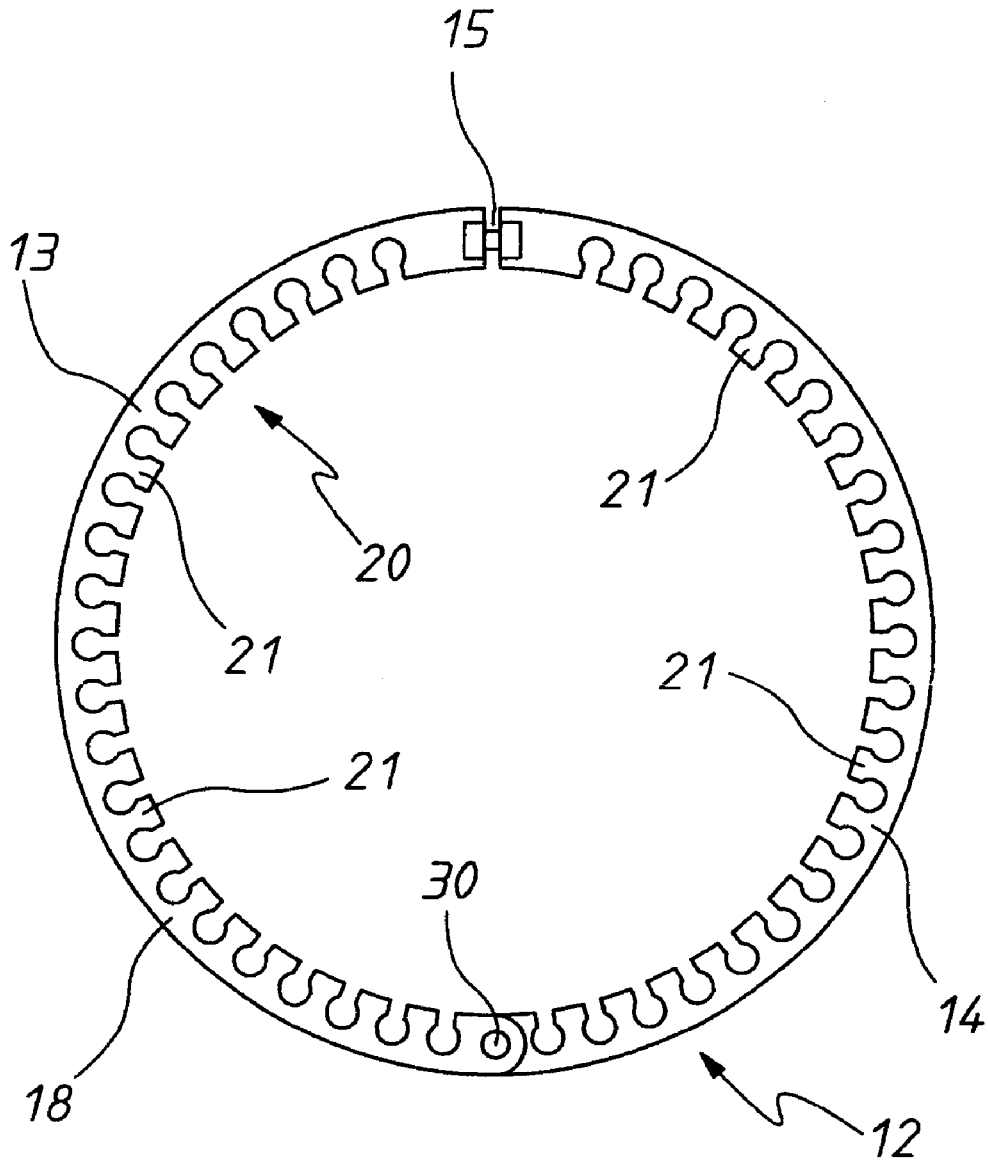
FIG. 4 is a plan view of the clamps of FIG. 3 and showing the clamps in an assembled condition.
Figure 5:
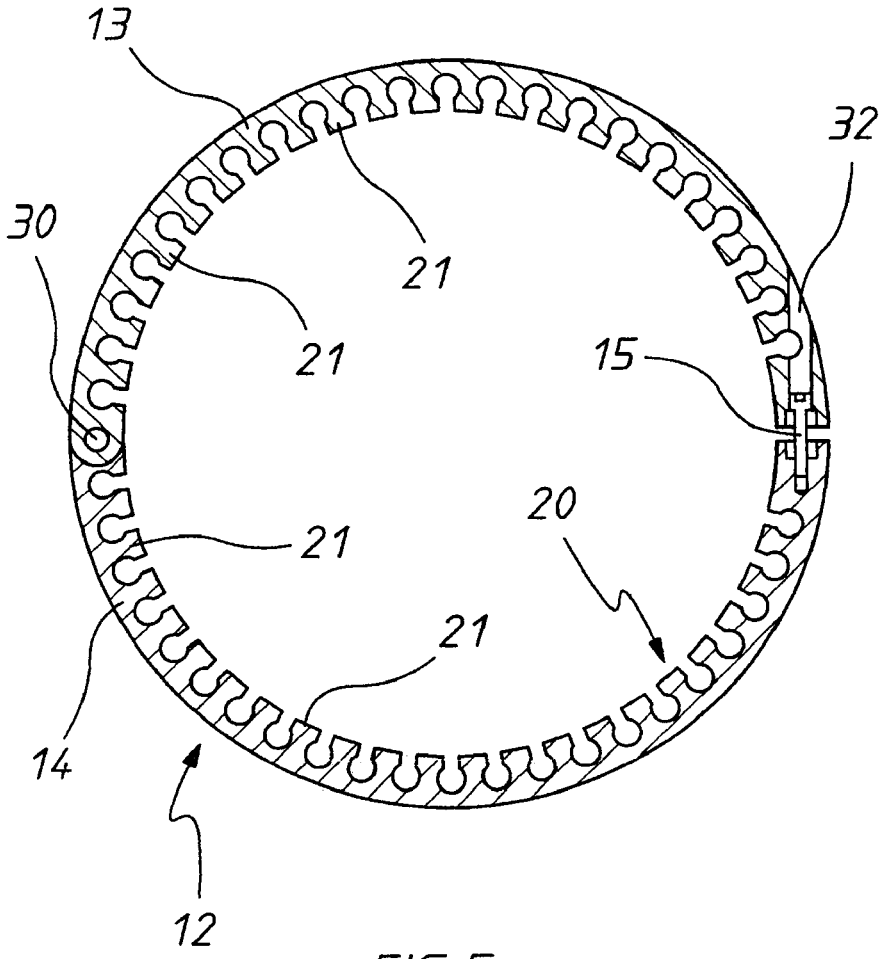
FIG. 5 is a cross-sectional view of the clamps of FIG. 4.

As seen in FIGS. 1 and 2, a pole 1 is illustrated mounted on a street and is preferably formed from galvanised steel pipe of constant circular transverse cross-section or aluminium tubing, again of constant circular transverse cross-section. Mounted on the pole 1 are a number of items of ancillary equipment including a street name sign 2, and a banner holder 3 (not seen in FIG. 1).

If desired, a sleeve of base cladding 4 can be provided. Such a base cladding sleeve 4 is not obligatory and can be omitted as being purely decorative. However, it is often used in order to hide covered access openings to internal electric wiring, traffic light equipment, and the like (not illustrated) which lies either between the cladding sleeve 4 and the pole 1 or within the pole 1. Vertical fluting 5 can be used on sleeve 4 to discourage those who would post advertising bills, or similar, on a street pole and also those who would wish to "decorate" the street pole with graffiti.

As best seen in FIGS. 1 and 2, the pole 1 is provided with at least one, and typically many clamps 6 which, as best seen in FIGS. 3 to 9, each preferably take the form of a vertically split collar 12. The collar 12 is fabricated from two parts 13 and 14 which are preferably identical and differ only in their orientation. The collar parts 13, 14 are able to be secured together by means of fasteners 15. Preferably a rubber cuff (not illustrated) formed in two parts is located between the collar 12 and the pole 1 in order that the collar 12 may better clamp against the outer surface of the pole 1.

The clamp 6 has an upper rim 18 and a lower rim 19 and is provided with an annular surface 20 located just below the upper rim 18 and on which is provided a regularly spaced apart multiplicity of teeth 21 in the form of shaped apertures.

It will be apparent to those skilled in the art that the clamp 6 can be located anywhere within a vertical range on the pole 1 and because of its essentially circular nature, the radial orientation of the clamp 6 is immaterial. Thus the clamp 6 is simply secured to the pole in the desired vertical position in whichever radial orientation is most convenient to the installer.

It will also be apparent to those skilled in the art that where the pole 1 is not itself circular but is, say, tapered with a circular transverse cross-sectional, then the rubber cuff can be provided with an appropriate taper in order that the clamp 12 securely grasps the pole 1. Since many installed poles are tapered, this provides the substantial advantage of a retrofit market in providing attachments for existing poles.

Furthermore, it will also be apparent to those skilled in the art that the cuff can include one or more engagement tongues or grooves (not illustrated) to accommodate keyed engagement with corresponding grooves or tongues disposed in/on the pole 1. For example the pole 1 can include four longitudinal grooves extending substantially the length of the pole in a north-south-east-west configuration in keeping with the above. Four longitudinally extending tongues (not illustrated) are disposed within the cuffs and are configured for keyed engagement with the pole grooves. In this way, the collar 12 can be automatically positioned into any one of the four configurations.

It will be seen that the street name sign 2 is mounted in a bracket 22 into which the sign 2 is actually received. The sign 2 can be of any nature, for example a street name sign, a speed limit sign, an information sign, etc. The bracket 22 also as a generally linear portion 25 is configured for engagement with upper 26 and lower 27 engagement portions. The engagement portions 26 and 27 include apertures 29 for receiving locking pin 28 in the form of a bolt.

It will be apparent to those skilled in the art that the bracket 22 with the street name sign 2 attached can be positioned by passing the lower and upper engagement portions 26 and 27 over the upper rim 18 of the clamp 6 so as to align the apertures 29 with shaped apertures 21 thereby providing a definite radial orientation for the street name sign 2. Furthermore, the bracket 22 and name sign 2 can remain hanging in the temporary position under the influence of gravity due to the cantilevered nature of the sign 2 urging the lower engagement portion 27 against the collar 12.

With the street name sign 2 temporarily located in this fashion, the installer can check that the radial orientation of the piece of ancillary equipment, in this case the street name sign 2, is correct before finally securing the piece of ancillary equipment in place by slotting locking pin 28 through the aperture of the upper engagement portion 26, the shaped aperture 21 and the aperture of the lower engagement portion 27. The locking pin threadably engages a corresponding threadably portion in the aperture of the lower engagement portion 27. In some instances this may require dismounting from a ladder in order to view the pole 1 from some distance, before re-mounting, the ladder in order to carry out the final securing operation with the bolts 28. In the case of mounting a directional antenna, for example, various electrical tests may need to be carried out without the installer being adjacent the antenna.

As noted, the final securing is brought about by means of slotting the locking bolts 28 through the upper engagement portion 26 apertures, through aligned shaped apertures 21 and through lower engagement portion 27 apertures which are threaded and thereby secure the auxiliary equipment 2 to the collar 6. In cases where no lower engagement portion 27 is provided, the bolts 28 are threadably engaged with threaded portions of the shaped apertures 21. Also, if the apertures 29 of the lower engagement portion 27 are not threaded, a nut (not illustrated) can be used to secure each bolt.

It will be apparent that the above described arrangement provided a number of substantial advantages. The vertical position of each collar 6 is infinitely variable so that the height of any ancillary equipment is completely adjustable. The radial orientation of the collar 6 is irrelevant as this can be easily checked for desired accuracy and, if necessary, adjusted before the final securing step. Auxiliary equipment can be later mounted in any radial orientation, or changed to any preferred radial orientation, as desired. The components can be relatively easily fabricated at low cost and installed in a short time, allowing for the use of single handed installation (thereby enhancing the safety of the installer). The low fabrication cost means that many less wealthy local government areas can improve the appearance of their streetscape for a low expenditure.

Figure 6:
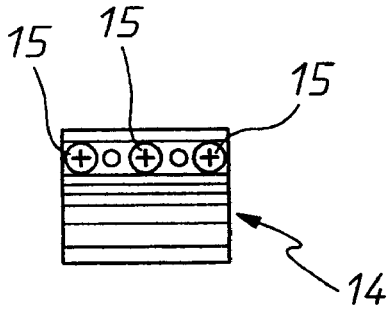
FIG. 6 is a sectional view along the line E-E of FIG. 4.
Figure 7:
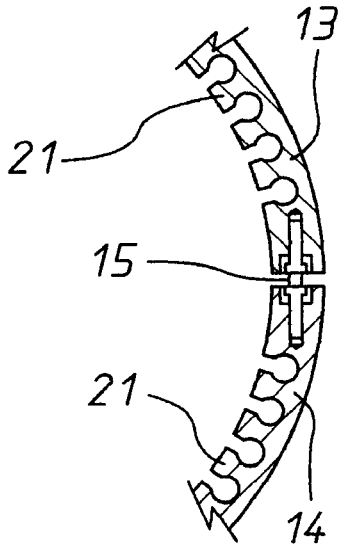
FIG. 7 is an enlarged view of the tightening means of the clamps of FIG. 4.
Figure 8:
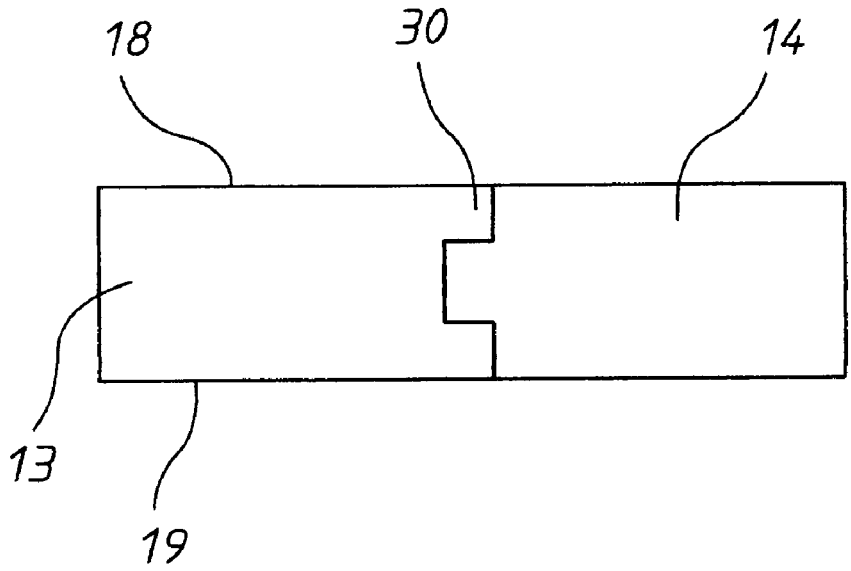
FIG. 8 is a front view of the clamps of FIG. 4.
Figure 9:
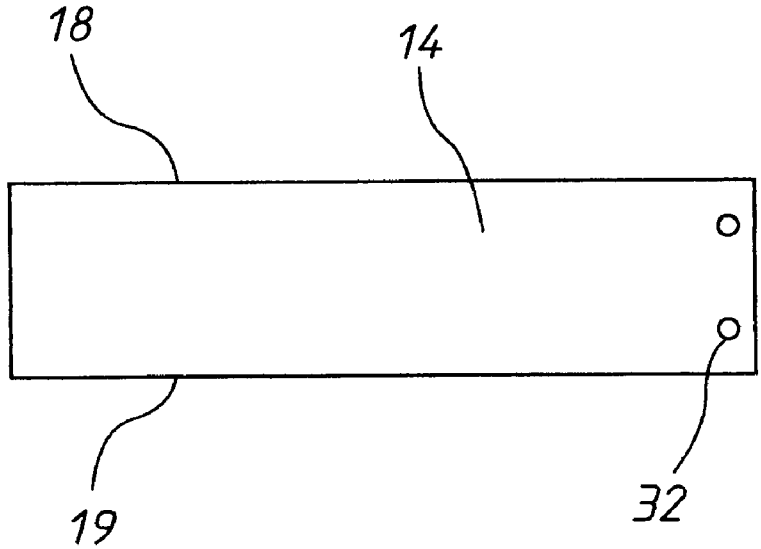
FIG. 9 is a right side view of the clamps of FIG. 4.

Referring to FIGS. 4 to 9, there is shown various views of the collar 6. The collar parts 13 and 14 are hingedly mounted about a hinge point 30. The clamp parts 13 and 14 are bought together to form a substantially circular clamp 6. The unhinged portions of the clamp parts 13 and 14 are secured together by hidden screws 15. FIG. 6 shows the use of the three screws 15 that are received through an aperture 32 of clamp part 14 and engage with female threaded portions disposed at the end of apertures 32 or clamp part 13.

It will be apparent that mainly variations of the system are possible. For example a single locking pin 28 can be used together with one or more apertures in the upper 26 and, when used, lower 27 engagement portions similarly, the hinge point 30 can be a hinge pin or other hinge.

It will also be apparent to those skilled in the art that the collars can be any preferred size, for example, to conform to existing pole sizes or to any other predetermined pole size. Furthermore, it will also be apparent that advertising or other indicia (not illustrated) can be disposed around the outside of the collar parts 13 and 14. For example, the outside of the collar parts can include a recess in their surface to receive printed material, where the recess can be covered by a removably mountable and transparent cover.

It can be seen that the pole mounting system of the preferred embodiment advantageously minimises clutter caused by the mounting of a plurality of auxiliary equipment to a pole. Further, a plurality of auxiliary equipment can be secured to a pole the same distance from the ground. Hitherto, it was known to mount a plurality of auxiliary equipment in a spaced apart manner along the longitudinal length of the pole.

The foregoing describes only some embodiments of the present invention and modifications, obvious to those skilled in the art, can be made thereto without departing from the scope of the present invention. For example, the two clamps 6 can be hinged together. Also a sealed cable entry between the pole interior and, say, an antenna can be provided.

In the case where the pole 1 includes longitudinal grooves (or tongues) for keyed engagement with correspondingly tongues (or grooves) on the collar 6, those pole grooves can be used to align a plurality of collars 6 disposed along the pole 1. Likewise, when only one collar 6 is provided on different poles, the collars can be aligned with each other using the groove and tongue arrangement.

The term "comprising" (and its grammatical variations) as used herein is used in the inclusive sense of "having" or "including" and not in the exclusive sense of "consisting only of".

We claim:

1. A pole mounting system for attaching one or more auxiliary equipment items to street poles, said system comprising a pair of substantially part cylindrical clamps, said clamps including tightening means to advance said clamps towards each other and thereby grasp an elongate pole having a longitudinal axis about a substantially transverse cross-section thereof wherein each of said clamps includes a plurality of spaced apart locator sites positioned on a radially inner surface of each said clamp and extending substantially around the entirety of the inner surface, said locator sites opening in a direction substantially parallel to said pole axis and wherein each of said auxiliary equipment intended for attachment to said street poles includes an upper engagement portion having at least one aperture alignable with a corresponding locator site opening on one of said clamps for receiving a locking pin to extend through said aperture and into engagement with said corresponding locator site opening whereby each said item of auxiliary equipment can be temporarily supported by inter-engagement of said locking pin through said upper engagement portion aperture and corresponding locator site opening, and the radial positioning of said auxiliary equipment item verified before each said auxiliary equipment item is finally secured to said clamps via said selected one locator site.

2. The system according to claim 1 wherein disposed in each locator site is a thread for inter-engaging with said locking pin which is a threaded bolt that corresponds with and is configured to inter-engage with said thread disposed in each locator site.

3. The system according to claim 1 wherein said upper engagement portion includes a pair of spaced apart apertures each configured for receiving a locking pin therethrough wherein each pin is configured for engagement with a locator site.

4. The system according to claim 1 wherein each of said auxiliary equipment includes a lower engagement portion having the same number of spaced apart apertures as said upper engagement portion such that said locking pin(s) is configured for inter-engagement with said lower engagement portion apertures after passing through said upper engagement portion aperture(s) and said locator site(s).

5. The system according to claim 1 wherein said locator sites comprise a plurality of regularly spaced apart slots.

6. The system according to claim 1 wherein said locator site slots are located on an upper rim of said clamps.

7. The system according to claim 1 wherein said auxiliary equipment upper engagement portion is configured to receive an auxiliary stem.

8. The system according to claim 7 wherein said auxiliary equipment includes a lower engagement portion and wherein said stem is configured to inter-engage with said upper and lower engagement portions.

9. The system according to claim 8 wherein said pair of substantially part cylindrical clamps are hingedly interconnected.

* * * * *